US011708700B2

(12) United States Patent
Bates

(10) Patent No.: US 11,708,700 B2
(45) Date of Patent: Jul. 25, 2023

(54) WAVE GENERATION ASSEMBLY

(71) Applicant: Mark Bates, Watauga, TX (US)

(72) Inventor: Mark Bates, Watauga, TX (US)

( * ) Notice: Subject to any disclaimer, the term of this patent is extended or adjusted under 35 U.S.C. 154(b) by 13 days.

(21) Appl. No.: 17/405,154

(22) Filed: Aug. 18, 2021

(65) Prior Publication Data

US 2023/0056207 A1 Feb. 23, 2023

(51) Int. Cl.
*E04H 4/00* (2006.01)
*A63B 69/00* (2006.01)

(52) U.S. Cl.
CPC ..... *E04H 4/0006* (2013.01); *A63B 69/0093* (2013.01)

(58) Field of Classification Search
CPC ..... E04H 4/0006
USPC ..... 4/491, 488, 54.1; 405/52; 482/55
See application file for complete search history.

(56) References Cited

U.S. PATENT DOCUMENTS 3,473,334 A 10/1969 Dexter
4,142,258 A * 3/1979 Schiron ..... E04H 4/0006 4/491
4,515,500 A 5/1985 Bastenhof
4,792,260 A 12/1988 Sauerbier
4,932,009 A * 6/1990 Lynch ..... G08B 21/082 367/136
D794,825 S 8/2017 Pain
10,407,927 B1 9/2019 Spriggs
10,760,290 B1 * 9/2020 Bennett ..... F04D 33/00
2009/0217451 A1 * 9/2009 Johnson ..... F04D 35/00 4/491
2013/0034430 A1 * 2/2013 Braswell ..... F03B 17/061 415/182.1
2018/0106058 A1 * 4/2018 McFarland ..... A63B 69/0093
2018/0224164 A1 * 8/2018 Lakic ..... F24S 90/00
2022/0282508 A1 * 9/2022 Dawson ..... A63B 69/0093

FOREIGN PATENT DOCUMENTS

AU 2017272297 A1 * 1/2018 ..... A63B 69/0093
CN 107106897 A * 8/2017 ..... A63B 69/0093
EP 0293831 9/1991
GB 2456763 A * 7/2009 ..... A63B 69/125
WO WO-9203201 A * 3/1992 ..... A63G 21/18
WO WO-2015082589 A1 * 6/2015 ..... E04H 4/0006
WO WO-2019191669 A1 * 10/2019 ..... F03G 6/001

OTHER PUBLICATIONS

US 10,557,277 B2, 02/2020, Fincham (withdrawn)

* cited by examiner

*Primary Examiner* — Lori L Baker

(57) ABSTRACT

A wave generation assembly for producing a wave in a pool for surfing includes a below ground pool that is filled with water. A boat hull is integrated into the below ground pool and the boat hull is partially submerged in the water contained in the below ground pool. An outlet jet is coupled to the boat hull such that the outlet jet is submerged in the water. A propulsion unit is integrated into the boat hull and the propulsion unit is in fluid communication with the outlet jet. The propulsion unit urges the water outwardly through the outlet jet at a velocity sufficient to generate a wave in the water which extends away from the boat hull. In this way the outlet jet facilitates the user to surf on the wave generated by the outlet jet.

6 Claims, 4 Drawing Sheets

WAVE GENERATION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to wave device and more particularly pertains to a new wave device for producing a wave in a pool for surfing. The device includes a below ground pool and a boat hull that is integrated into the below ground pool. The device includes an outlet jet that is integrated into the boat hull and a propulsion unit that urges water outwardly through the outlet jet to produce a wave in the below ground pool. In this way a user can surf on the wave in the below ground pool.

(2) Description of Related Art Including Information Disclosed Under 37 CFR 1.97 and 1.98

The prior art relates to wave devices including a variety of wave generation devices that each includes a panel which is urged back and forth in a pool to produce a wave in the pool. The prior art discloses a wave generation device that includes a plurality of combustion chambers that are in fluid communication with a pool for inducing positive pressure in a pool to produce a wave. The prior art discloses a wave generator that includes a pool and a strategically shaped hull that is urged to travel beneath water in the pool to produce a wave. The prior art discloses a wave generator that includes a pool and a foil that is positioned in the pool which can be oriented at a variety of different geometries to produce a wave in the pool.

BRIEF SUMMARY OF THE INVENTION

An embodiment of the disclosure meets the needs presented above by generally comprising a below ground pool that is filled with water. A boat hull is integrated into the below ground pool and the boat hull is partially submerged in the water contained in the below ground pool. An outlet jet is coupled to the boat hull such that the outlet jet is submerged in the water. A propulsion unit is integrated into the boat hull and the propulsion unit is in fluid communication with the outlet jet. The propulsion unit urges the water outwardly through the outlet jet at a velocity sufficient to generate a wave in the water which extends away from the boat hull. In this way the outlet jet facilitates the user to surf on the wave generated by the outlet jet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
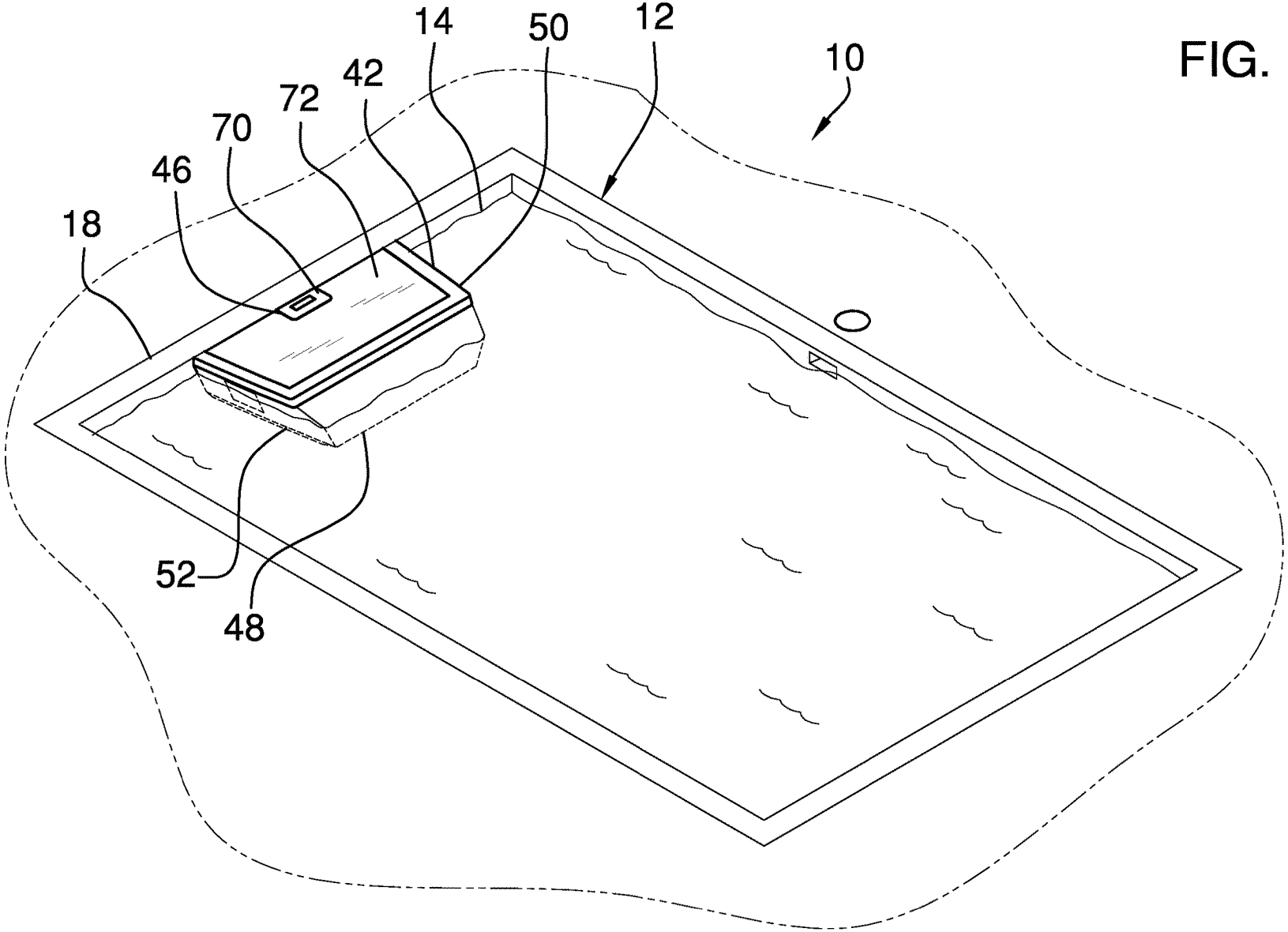
FIG. 1 is a top perspective view of a wave generation assembly according to an embodiment of the disclosure.
Figure 2:
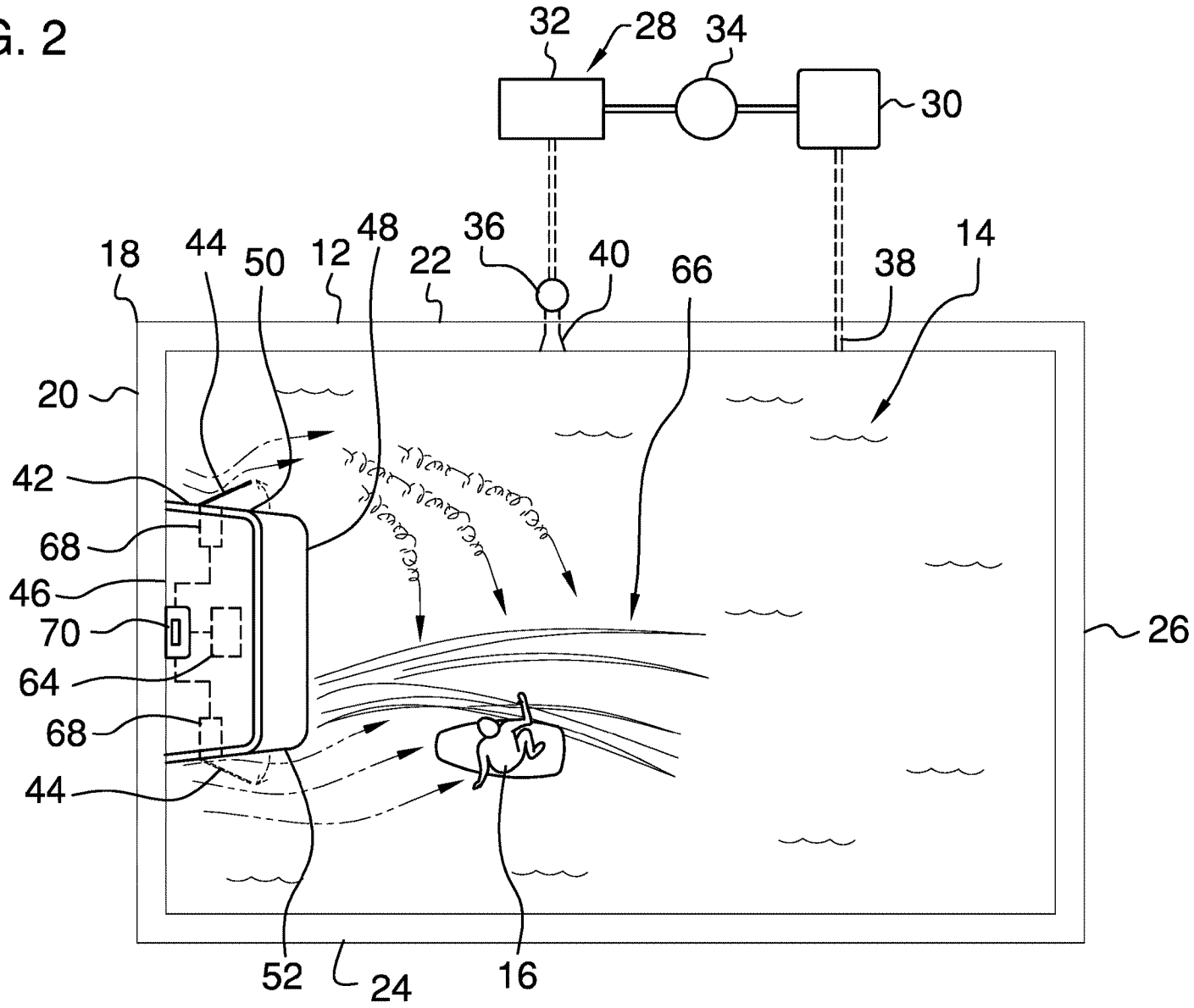
FIG. 2 is a perspective in-use view of an embodiment of the disclosure.
Figure 3:
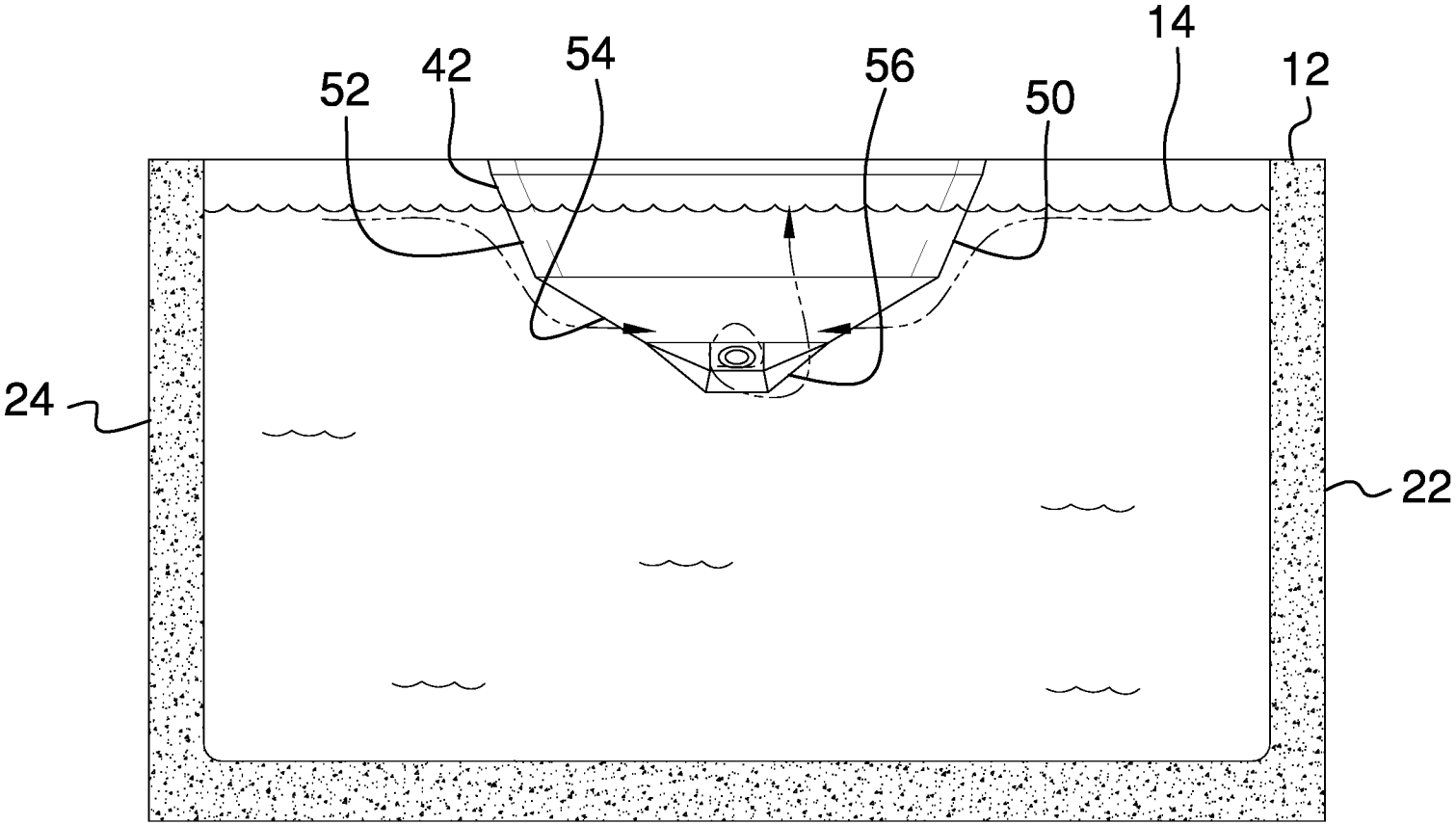
FIG. 3 is a rear cut-away view of an embodiment of the disclosure.
Figure 4:
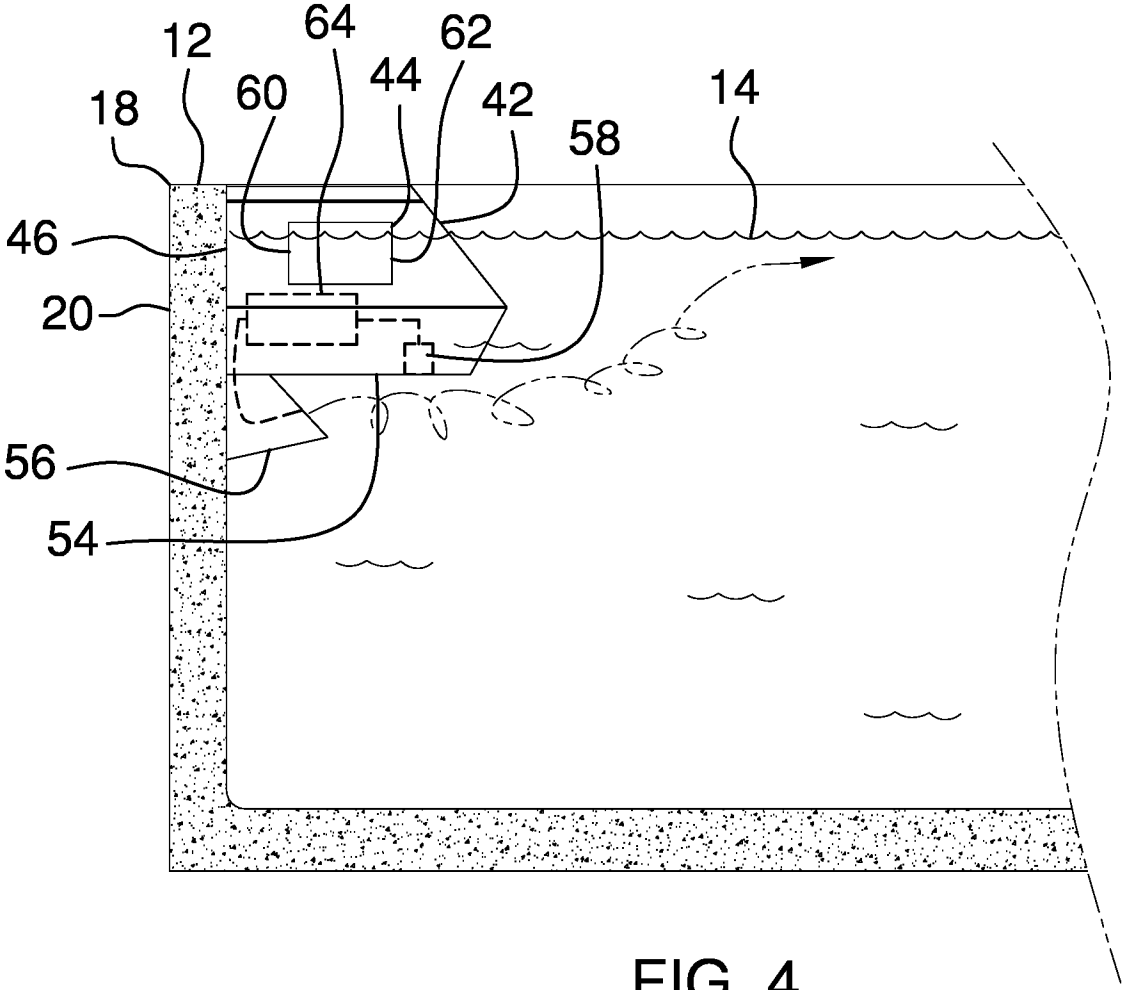
FIG. 4 is a left side cut-away view of an embodiment of the disclosure.

With reference now to the drawings, and in particular to FIGS. 1 through 4 thereof, a new wave device embodying the principles and concepts of an embodiment of the disclosure and generally designated by the reference numeral 10 will be described.

As best illustrated in FIGS. 1 through 4, the wave generation assembly 10 generally comprises a below ground pool 12 that is filled with water 14 to facilitate a user 16 to swim in the below ground pool 12. The below ground pool 12 has a bounding wall 18 and the bounding wall 18 has a front side 20, a first sidelong side 22, a second sidelong side 24 and a back side 26. As is most clearly shown in FIG. 2, the below ground pool 12 may include a pool filtration system 28 which may include a water pump 30, a water heater 32, a water filter 34 and a debris filter 36. Additionally, the bounding wall 18 may include a intake port 38 and an exhaust port 40, and the water pump 30, the water heater 32, the water filter 34 and the debris filter 36 may be arranged in series between the intake port 38 and the exhaust port 40 for filtering and heating the water 14 in the below ground pool 12.

A boat hull 42 is integrated into the below ground pool 12 and the boat hull 42 is strategically positioned such that the boat hull 42 is partially submerged in the water 14 contained in the below ground pool 12. The boat hull 42 has a pair of panels 44 that is each hingedly integrated into the boat hull 42 and each of the panels 44 is positionable between a deployed position and a stored position. Each of the panels 44 extends laterally away from the boat hull 42 when the panels 44 are positioned in the deployed position.

The boat hull 42 has a forward side 46, a rear side 48, a first lateral side 50, a second lateral side 52 and a bottom side 54. The forward side 46 is fixed to the front side 20 of the bounding wall 18 of the below ground pool 12 and the boat hull 42 is centrally positioned between the first sidelong side 22 and the second sidelong side 24 of the bounding wall 18. Furthermore, the bottom side 54 is submerged in the water 14 and an outlet jet 56 is coupled to the bottom side 54 such that the outlet jet 56 is submerged in the water 14. The outlet jet 56 is directed toward the rear side 48 of the boat hull 42. Additionally, the bottom side 54 has an intake 58 extending through the bottom side 54 thereby facilitating the water 14 to pass through the intake 58.

Each of the panels 44 is integrated into a respective one of the first lateral side 50 and the second lateral side 52, and each of the panels 44 has a coupled end 60 and a free end 62. The coupled end 60 of each of the panels 44 is hingedly coupled to the respective first lateral side 50 and the second lateral side 52 at a point that is located adjacent to the forward side 46 of the boat hull 42. Each of the panels 44 is oriented such that an axis extending between the coupled end 60 and the free end 62 is oriented parallel with an axis extending between the forward side 46 and rear side 48 of the boat hull 42. Each of the panels 44 angles outwardly from the respective first lateral side 50 and the second lateral side 52 when the panels 44 are in the deployed position. Conversely, each of the panels 44 lies on a plane that is oriented coplanar with the respective first lateral side 50 and the second lateral side 52 of the boat hull 42.

A propulsion unit 64 is integrated into the boat hull 42 and the propulsion unit 64 is in fluid communication with the outlet jet 56. The propulsion unit 64 urges the water 14 outwardly through the outlet jet 56 at a velocity sufficient to generate a wave 66 in the water 14 that extends away from the boat hull 42. In this way the outlet jet 56 facilitates the user 16 to surf on the wave 66 generated by the outlet jet 56. Additionally, the propulsion unit 64 is in fluid communication with the intake 58 on the bottom side 54 of the boat hull 42. The propulsion unit 64 may be an electrically actuated water pump that has a similar output capacity to that of a propulsion system of a jet boat which is commonly employed for waterskiing, wakeboarding and other types of water sports. Additionally, the boat hull 42 may be structured in a manner that is similar to that of jet boats that are employed for waterskiing, wakeboarding and other types of water sports.

A pair of actuators 68 is provided and each of the actuators 68 is integrated into the boat hull 42. Each of the actuators 68 is in mechanical communication with a respective one of the panels 44. Additionally, each of the actuators 68 urges the respective panels 44 between the deployed position and the stored position. Each of the panels 44 alters a flow of the water 14 when the wave 66 is generated by the outlet jet 56 and when either of the panels 44 is positioned in the deployed position. In this way each of the panels 44 can alter the shape of the wave 66 generated by the outlet jet 56. Each of the actuators 68 can be independently operated such that each of the panels 44 can be independently or simultaneously urged into the deployed position or the stored position.

A control panel 70 is integrated into a top side 72 of the boat hull 42 such that the control panel 70 is accessible to the user 16. The control panel 70 is in communication with the propulsion unit 64 for controlling operational parameters of the propulsion unit 64. Moreover, the operational parameters include actuating the propulsion unit 64, de-actuating the propulsion unit 64 and adjusting the predetermined velocity of the wave 66 generated by the outlet jet 56. The control panel 70 is electrically coupled to each of the actuators 68 and the control panel 70 facilitates each of the actuators 68 to be independently actuated and de-actuated for respectively urging the respective panels 44 between the deployed position and the stored position. Additionally, the control panel 70 is electrically coupled to the propulsion unit 64 and the control panel 70 is electrically coupled to a power source comprising an electrical system associated with the below ground pool 12.

In use, the propulsion unit 64 is actuated to urge water 14 outwardly through the outlet jet 56 in order to generate the wave 66. In this way the user 16 can surf or wakeboard on the wave 66 that is generated. Either of the panels 44 can be urged into the deployed position to alter the shape of the wave 66 that is generated. In this way the user 16 can surf or wakeboard in the below ground pool 12 on a variety of different shapes of wave 66*s*. Additionally, the velocity of the propulsion unit 64 can be adjusted to alter the shape and intensity of the wave 66 that is generated.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wave generation assembly for generating a wave for surfing in a pool, said assembly comprising:

a below ground pool being filled with water wherein said below ground pool is configured to facilitate a user to swim in said below ground pool;

a boat hull being integrated into said below ground pool, said boat hull being strategically positioned such that said boat hull is partially submerged in said water contained in said below ground pool, said boat hull having a pair of panels each being hingedly integrated into said boat hull, each of said panels being positionable between a deployed position and a stored position, each of said panels extending laterally away from said boat hull when said panels are positioned in said deployed position, said boat hull having an outlet jet being coupled to said boat hull such that said outlet jet is submerged in said water; and a propulsion unit being integrated into said boat hull, said propulsion unit being in fluid communication with said outlet jet, said propulsion unit urging said water outwardly through said outlet jet at a velocity sufficient to generate a wave in said water extending away from said boat hull wherein said outlet jet is configured to facilitate the user to surf on said wave generated by said outlet jet.

2. The assembly according to claim 1, wherein:

said below ground pool has a bounding wall, said bounding wall having a front side, a first sidelong side, a second sidelong side and a back side; and said boat hull has a forward side, a rear side, a first lateral side, a second lateral side and a bottom side, said forward side being fixed to said front side of said bounding wall of said below ground pool, said boat hull being centrally positioned between said first sidelong side and said second sidelong side of said bounding wall, said bottom side being submerged in said water.

3. The assembly according to claim 2, wherein:

said outlet jet is positioned on said bottom side of said boat hull, said outlet jet being directed toward said rear side of said boat hull, said bottom side having an intake extending through said bottom side thereby facilitating said water to pass through said intake;

each of said panels is integrated into a respective one of said first lateral side and said second lateral side, each of said panels having a coupled end and a free end, said coupled end of each of said panels being hingedly coupled to said respective first lateral side and said second lateral side at a point being located adjacent to said forward side of said boat hull, each of said panels being oriented such that an axis extending between said coupled end and said free end is oriented parallel with an axis extending between said forward side and rear side of said boat hull; and each of said panels angles outwardly from said respective first lateral side and said second lateral side when said panels are in said deployed position, each of said panels lying on a plane being oriented coplanar with said respective first lateral side and said second lateral side of said boat hull.

4. The assembly according to claim 1, further comprising a pair of actuators, each of said actuators being integrated into said boat hull, each of said actuators being in mechanical communication with a respective one of said panels, each of said actuators urging said respective panels between said deployed position and said stored position.

5. The assembly according to claim 4, further comprising a control panel being integrated into said boat hull wherein said control panel is configured to be accessible to the user, said control panel being in communication with said propulsion unit for controlling operational parameters of said propulsion unit, said operational parameters including actuating said propulsion unit, de-actuating said propulsion unit and adjusting said predetermined velocity of said wave generated by said outlet jet, said control panel being electrically coupled to each of said actuators, said control panel facilitating each of said actuators to be independently actuated and de-actuated for respectively urging said respective panels between said deployed position and said stored position, said control panel being electrically coupled to said propulsion unit, said control panel being electrically coupled to a power source comprising an electrical system associated with said below ground pool.

6. A wave generation assembly for generating a wave for surfing in a pool, said assembly comprising:

a below ground pool being filled with water wherein said below ground pool is configured to facilitate a user to swim in said below ground pool, said below ground pool having a bounding wall, said bounding wall having a front side, a first sidelong side, a second sidelong side and a back side;

a boat hull being integrated into said below ground pool, said boat hull being strategically positioned such that said boat hull is partially submerged in said water contained in said below ground pool, said boat hull having a pair of panels each being hingedly integrated into said boat hull, each of said panels being positionable between a deployed position and a stored position, each of said panels extending laterally away from said boat hull when said panels are positioned in said deployed position, said boat hull having a forward side, a rear side, a first lateral side, a second lateral side and a bottom side, said forward side being fixed to said front side of said bounding wall of said below ground pool, said boat hull being centrally positioned between said first sidelong side and said second sidelong side of said bounding wall, said bottom side being submerged in said water, said bottom side having an outlet jet being coupled to said bottom side such that said outlet jet is submerged in said water, said outlet jet being directed toward said rear side of said boat hull, each of said panels being integrated into a respective one of said first lateral side and said second lateral side, each of said panels having a coupled end and a free end, said coupled end of each of said panels being hingedly coupled to said respective first lateral side and said second lateral side at a point being located adjacent to said forward side of said boat hull, each of said panels being oriented such that an axis extending between said coupled end and said free end is oriented parallel with an axis extending between said forward side and rear side of said boat hull, each of said panels angling outwardly from said respective first lateral side and said second lateral side when said panels are in said deployed position, each of said panels lying on a plane being oriented coplanar with said respective first lateral side and said second lateral side of said boat hull, said bottom side having an intake extending through said bottom side thereby facilitating said water to pass through said intake;

a propulsion unit being integrated into said boat hull, said propulsion unit being in fluid communication with said outlet jet, said propulsion unit urging said water outwardly through said outlet jet at a velocity sufficient to generate a wave in said water extending away from said boat hull wherein said outlet jet is configured to facilitate the user to surf on said wave generated by said outlet jet, said propulsion unit being in fluid communication with said intake on said bottom side of said boat hull;

a pair of actuators, each of said actuators being integrated into said boat hull, each of said actuators being in mechanical communication with a respective one of said panels, each of said actuators urging said respective panels between said deployed position and said stored position, each of said panels altering a flow of said water when said wave is generated by said outlet jet and when either of said panels is positioned in said deployed position wherein each of said panels is configured to alter the shape of said wave generated by said outlet jet; and a control panel being integrated into said boat hull wherein said control panel is configured to be accessible to the user, said control panel being in communication with said propulsion unit for controlling operational parameters of said propulsion unit, said operational parameters including actuating said propulsion unit, de-actuating said propulsion unit and adjusting said predetermined velocity of said wave generated by said outlet jet, said control panel being electrically coupled to each of said actuators, said control panel facilitating each of said actuators to be independently actuated and de-actuated for respectively urging said respective panels between said deployed position and said stored position, said control panel being electrically coupled to said propulsion unit, said control panel being electrically coupled to a power source comprising an electrical system associated with said below ground pool.

* * * * *